US006458256B1

(12) United States Patent
Zhong

(10) Patent No.: US 6,458,256 B1
(45) Date of Patent: Oct. 1, 2002

(54) LOW POWER ELECTRICALLY-DRIVEN MICROFLUIDIC PUMPING/DELIVERY DEVICE

(75) Inventor: Chuan-Jian Zhong, Johnson City, NY (US)

(73) Assignee: The Research Foundation of the State University of New York,, NY (US)

( * ) Notice: Subject to any disclaimer, the term of this patent is extended or adjusted under 35 U.S.C. 154(b) by 50 days.

(21) Appl. No.: 09/688,049

(22) Filed: Oct. 13, 2000

(51) Int. Cl.[7] ..... C25B 9/00
(52) U.S. Cl. ..... 204/242; 204/275.1
(58) Field of Search ..... 204/242, 275.1

(56) References Cited

U.S. PATENT DOCUMENTS 5,472,577 A 12/1995 Porter et al.

OTHER PUBLICATIONS

"Microfluidics—a Review", Peter Gravesen, Jens Branebjerg and Ole Sondergard Jensen, Journal of Micromechanical Engineering and Microengineering 3, 168 (1993) (no month).

*Primary Examiner*—Donald R. Valentine
(74) *Attorney, Agent, or Firm*—Salzman & Levy

(57) ABSTRACT

An electrically-actuated microfluidic device for fluid delivery and pumping is described. The micropumping device is configured as a capillary tube containing immiscible electrolyte liquids that are subjected to an alternating electrical voltage. The electrical voltage causes the boundary between the two liquids to change its surface tension in a way that provides a pumping action. The micropump requires only a few volts and milliwatts in order to operate.

14 Claims, 5 Drawing Sheets

(1 of 5 Drawing Sheet(s) Filed in Color)

Moving Boundary

LOW POWER ELECTRICALLY-DRIVEN MICROFLUIDIC PUMPING/DELIVERY DEVICE

FIELD OF THE INVENTION

The present invention relates to microfluidic devices and, more particularly, to a micropump that is electrically driven by a change of surface tension at an electrical double layer interface between two immiscible electrolyte fluids configured within a capillary.

BACKGROUND OF THE INVENTION

The present invention is constructed in a similar manner to the mercury/electrolyte-based electrochemical micropump illustrated in U.S. Pat. No. 5,472,577, issued to Porter et al, on Dec. 5, 1995 for FLUID PUMPING SYSTEM BASED ON ELECTROCHEMICALLY-INDUCED SURFACE TENSION CHANGES. In the prior invention, the well-known surface tension change at the liquid metal (mercury) and the electrolyte interface was utilized as an actuation force for micropumping. Similar types of micropumping have received enormous interest, as described in "Microfluidics—A Review", by Gravesen, P., Branebjerg, J., and Jensen, O. S., Journal of Micromechanical and Microengineering 3, 168 (1993).

The micropump of the prior invention, while well constructed, leaves room for improvement because it uses mercury which is potentially hazardous.

The search for a more practical microfluidic system has spawned the current micropump. The present invention utilizes two immiscible electrolyte liquids, disposed within a capillary tube. The two immiscible liquid phases of the micropump can comprise a salt in an aqueous solution and an organic liquid, for example. The variation of electrical potentials at the interface is determined by the distribution of ionic/dipolar components in the liquids. Across the interface, there is an excess electrical charge on one side, and an excess opposite charge on the other side. The excess charge occurs by reason of electroneutrality, resulting in an electrical double layer with electrochemically controllable interfacial tension. The invention uses a change in surface tension across the interface as the driving force for operating the pump.

The organic liquid phase of the micropump can comprise, for example, 1, 2-dichloroethane with tetraphenylammonium tetra-phenylborate as an electrolyte (phase-1), which is in contact with an aqueous solution of sodium chloride (phase-2). Each of the liquids is disposed in a glass capillary. The liquids form a clear immiscible boundary.

Two platinum wires are inserted into the liquids from each side of the boundary, respectively, and serve as two electrodes. The interfacial tension changes when an alternating voltage (e.g., a square waveform with 1~3 volts amplitude) is applied to the two electrodes. The voltage alternation causes the boundary line to move back and forth, creating a piston-type action. The magnitude of the piston displacement depends on the magnitude and the frequency of the alternating voltage. For example, a displacement up to 4 mm was demonstrated in a capillary having a 1 mm diameter, powered by a square-wave voltage of 2 volts having a 1 Hz frequency.

In comparison with many current micropump devices utilizing thermoneumatic, piezoelectric, and electroosmotic actuation, the present invention has lower power requirements. In addition, it is relatively easy to construct and integrate into small devices. In addition, the fluid components in the device can be provided by a relatively large selection of environmentally-friendly materials, an advantage desirable in terms of micro-fabrication, integration and biocompatibility.

SUMMARY OF THE INVENTION

In accordance with the present invention, there is provided a micropump for microfluidic applications. The micropump is configured as a glass capillary containing a pair of immiscible electrolyte liquids. The micropump operates on a principle of surface tension change at the electrical double layer interface between the two immiscible electrolyte liquids. The device generates fluid displacements when subjected to a small, alternating voltage. One of the immiscible liquids (phase-1) comprises an organic electrolyte (e.g., dichloroethane with tetraphenylammonium tetraphenylborate). The other immiscible liquid (phase-2) comprises an aqueous solution of sodium chloride. The liquids form a clear immiscible boundary.

Two platinum wires are inserted into the liquids from each side of the boundary, respectively, serving as two electrodes. The interfacial tension changes when an alternating voltage (e.g., a square waveform with 1~3 volts amplitude) is applied to the two electrodes. The voltage alternation causes the boundary line to move back and forth, creating a piston-type action. The magnitude of the piston displacement depends on the magnitude and the frequency of the alternating voltage.

It is an object of this invention to provide an improved microfluidic device.

It is another object of the invention to provide a micropump that uses interfacial surface tension between two immiscible electrolyte liquids to provide a pumping force generated by an applied alternating voltage.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features an electrically-actuated microfluidic device for fluid delivery and pumping. The micropump is configured as a capillary containing immiscible electrolyte liquids that are subjected to an alternating electrical voltage. The electrical voltage causes the boundary between the two liquids to change its surface tension in a way that provides a pumping action. The micropump requires only a few volts and milliwatts in order to operate.

Figure 1:
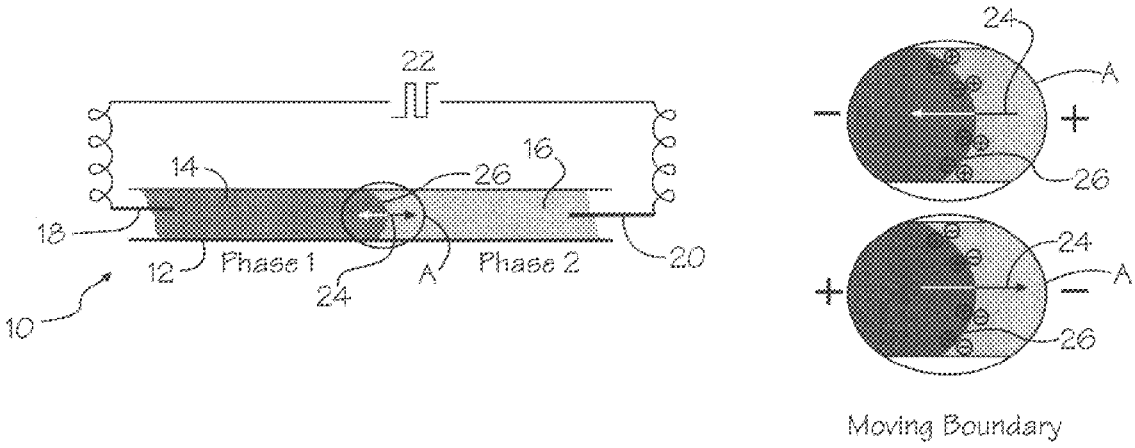
FIG. 1 illustrates a schematic, front view of the micropump of this invention.

Now referring to FIG. 1, the micropump 10 of this invention is illustrated. The micropump 10 comprises a capillary tube 12, in which two immiscible electrolyte liquids 14 and 16, respectively, are disposed. Two platinum wire electrodes 18 and 20 are inserted into the respective liquids 14 and 16, as shown. Each electrode 18 and 20 is connected to an opposite end of a square wave voltage source 22.

The interfacial boundary layer between the two respective liquids 14 and 16 (phases 1 and 2) is shown by the circular detail "A". Arrows 24 show the movement of the boundary layer 26 under the influence of the square wave voltage source 22. The micropump 10 generates fluid displacements (arrows 24) when subjected to the square wave voltage 22.

One of the immiscible liquids 14 (phase-l) comprises an organic electrolyte (e.g., 1,2-dichloroethane with tetraphenylammonium tetraphenylborate). The other immiscible liquid (phase-2) comprises an aqueous solution of an ionic salt, such as sodium chloride, sodium iodide, potassium chloride, etc. The respective liquids 14 and 16 form a clear immiscible boundary 26.

Figure 2:
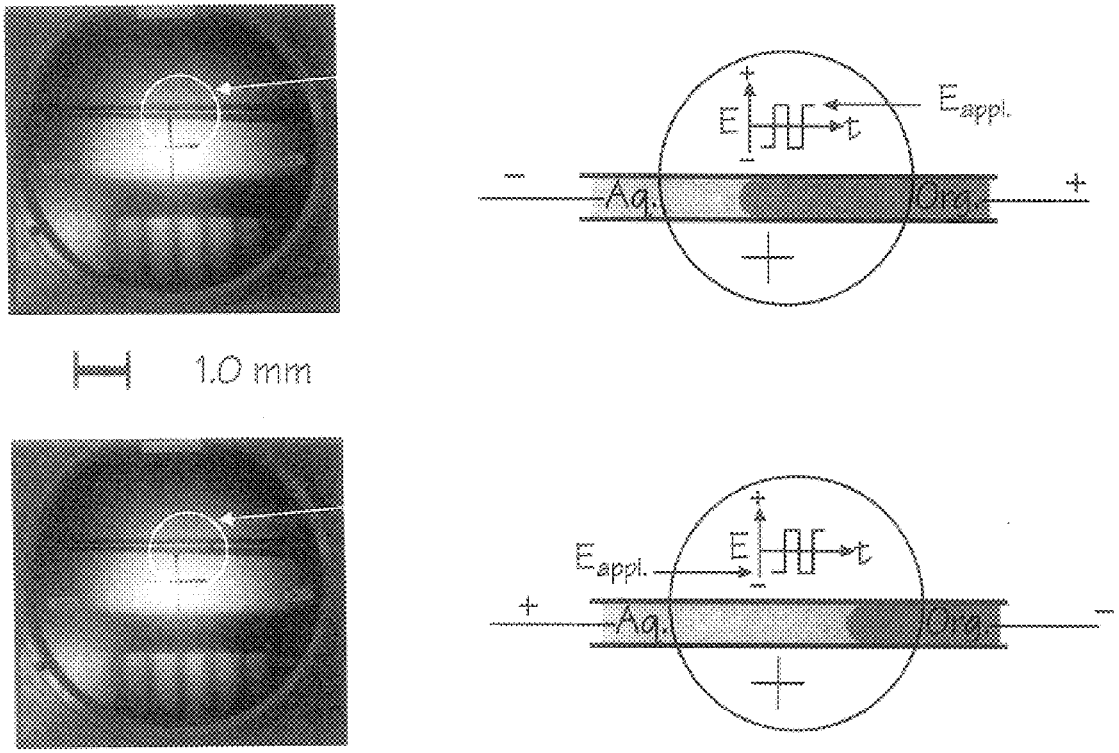
FIG. 2 shows magnified, photographic and corresponding schematic views of the immiscible liquid-liquid, interfacial boundary shown in FIG. 1, each view being of a boundary at an opposite polarity of the applied voltage.

Referring to FIG. 2, magnified views of the circular detail "A" are shown, as the polarity of the square wave voltage 22 is caused to change. It will be observed that the boundary interface 26 is caused to move by the change of surface tension induced by the voltage, as depicted by arrows 24.

The variation of electrical potentials at the interface is determined by the distribution of ionic/dipolar components in the liquids. Across the interface, there is an excess electrical charge on one side, and an excess opposite charge on the other side. The excess charge occurs by reason of electroneutrality, resulting in an electrical double layer with electrochemically controllable interfacial tension. The invention uses the change in surface tension across the interface 26 as the driving force for operating the micropump 10.

The micropump 10 of this invention can be used in applications that comprise, but are not necessarily limited to: 1) microchemical analysis/monitoring in environmental and medical fields, 2) controlled drug delivery devices (e.g., insulin delivery), 3) flow injection analysis and microchromatography integrated in microchip scales, and 4) artificial immuring systems.

Qualitatively, the results of the inventive procedure can be explained in terms of the interfacial tension changes under electrochemically-driven charging/discharging at the liquid-liquid boundary. The interfacial force is defined by the radius of curvature of the immiscible boundary. The switching of the applied voltage leads to a change of surface charge excess and consequently, a change in surface tension. When the voltage is applied so that the electrode in the organic phase is more positive with respect to that in the aqueous phase, positive charges accumulate on the organic side of the interfacial boundary; negative charges accumulate at the aqueous side of the boundary. The resulting surface tension pushes the boundary line from the organic phase to the aqueous phase. Conversely, when the electrode in the organic phase is more negative, negative charges accumulate on the organic side of the interfacial boundary, tending to push the boundary line from the aqueous phase to the organic phase.

Figure 3:
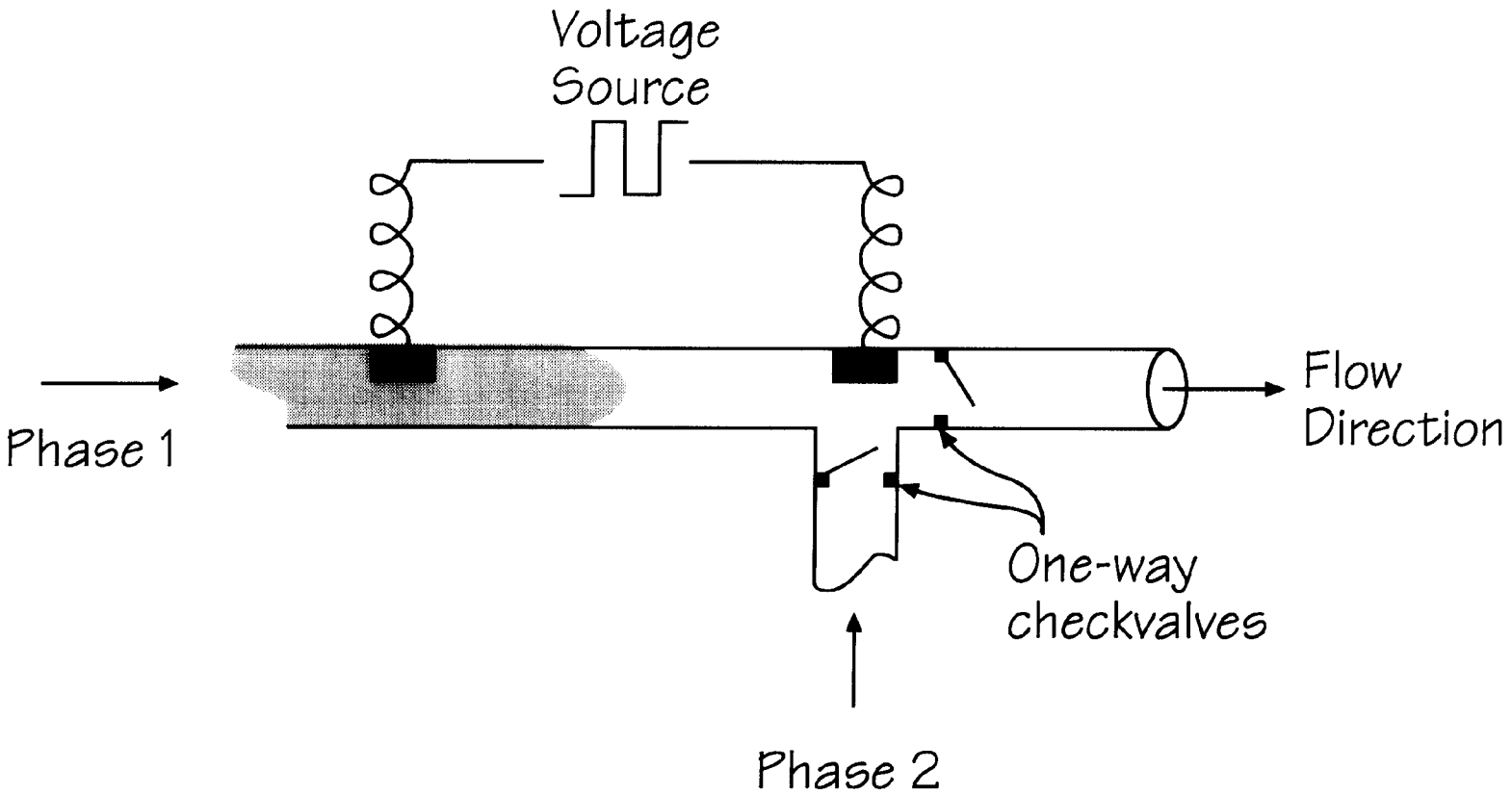
FIG. 3 is a schematic view of the micropump design, including two one-way checkvalves.

Referring now also to FIG. 3, a schematic view of the micropump is shown. Two platinum pads are embedded in the tube with exposed surface in contact with the liquid. These two pads function as two electrodes for applying square wave voltage across the immiscible liquid-liquid boundary. Two one-way checkvalves are used to direct the flow. In this case, phase-1 liquid functions as the pumping piston, whereas phase-2 liquid functions as the fluid to be pumped. The net result is the flow of phase-2 liquid, as indicated.

Figure 4:
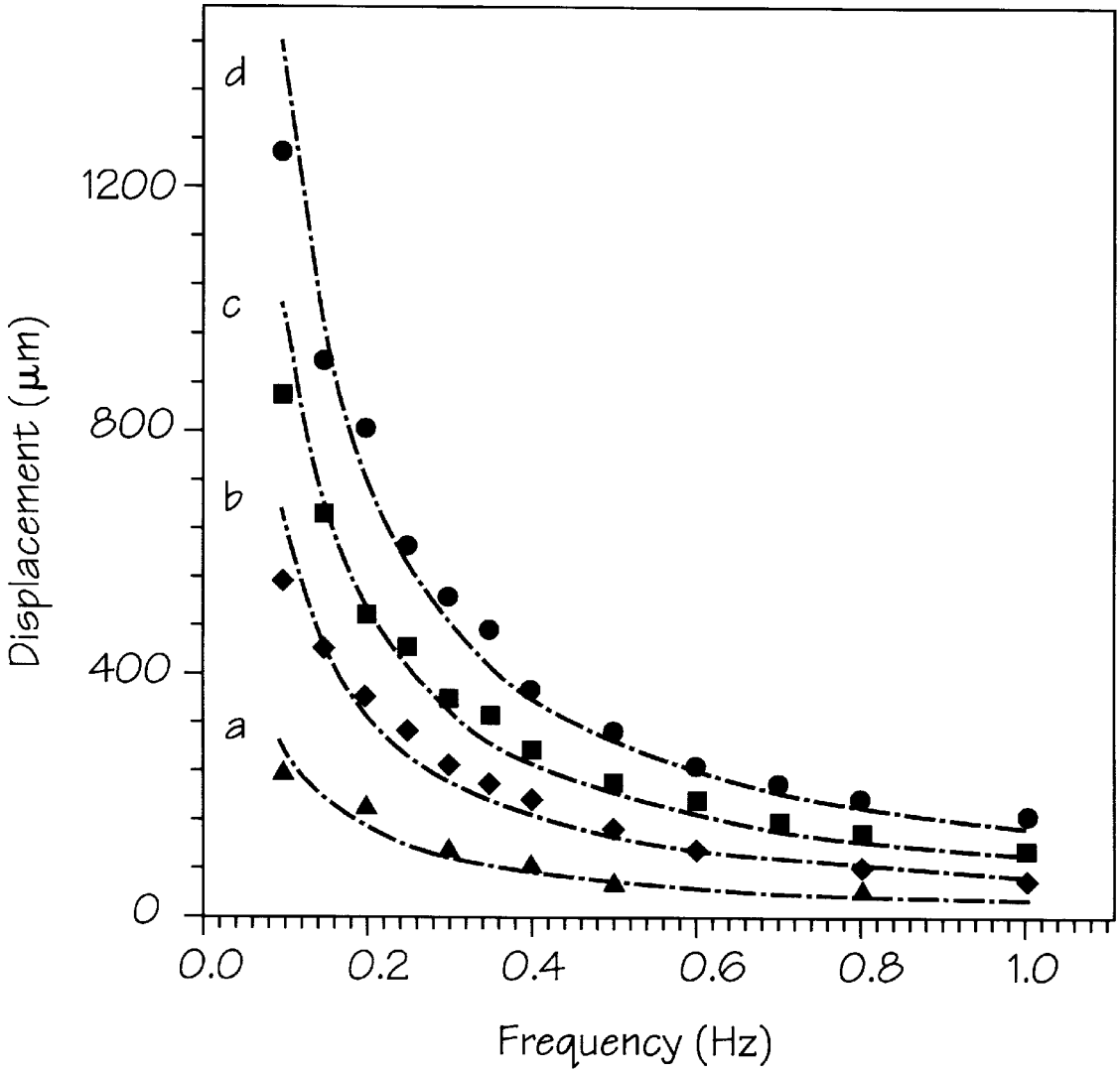
FIG. 4 is a graph of absolute displacement versus frequency for selected magnitudes of applied square waveform voltages a(1V), b(2V), c(3V) and d(4V)

FIG. 4 is a graph of displacement versus frequency for a number of applied voltage magnitudes. As the frequency increases, the displacement exponentially decreases to a value of less than 100 $\mu$m at a frequency greater than 1 Hz. The reported data, therefore, are only for frequency less than 1 Hz. At a constant frequency, the displacement increases with the magnitude of the applied voltage, indicating that a higher voltage induces a greater change in surface tension.

Figure 5:
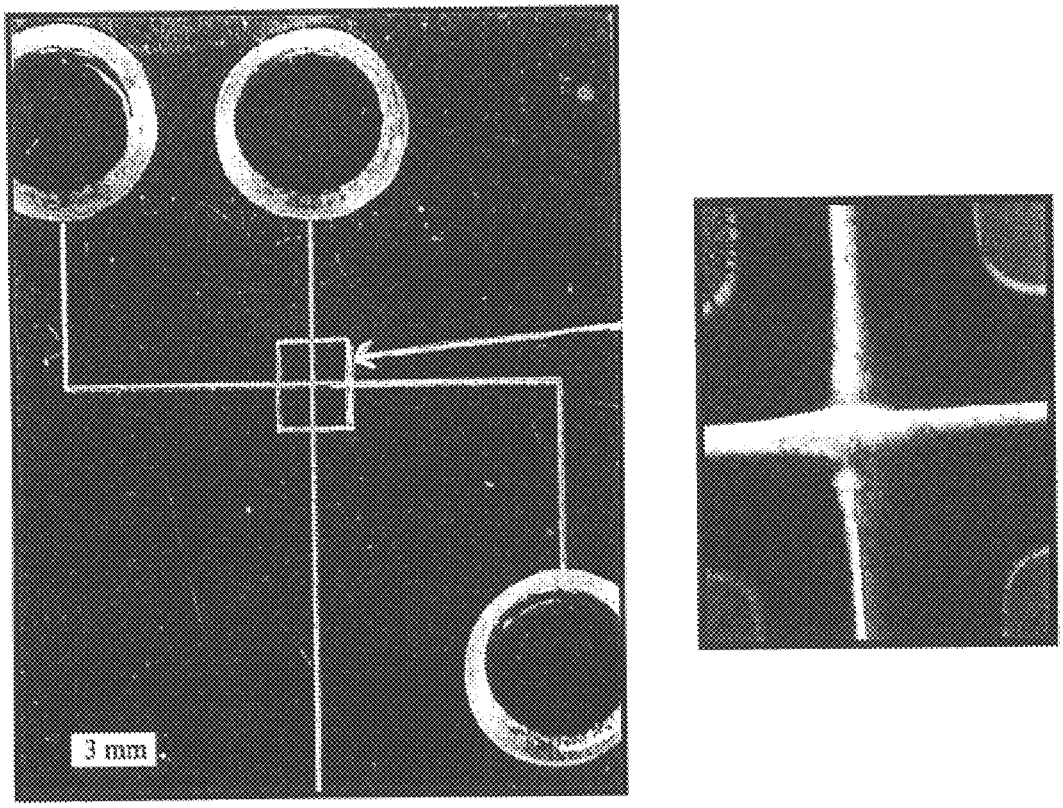
FIG. 5 is a top view of an analytical separation chip and a greatly enlarged portion thereof.

Referring now to FIG. 5, there is shown a photograph of the immiscible liquid-liquid interfacial actuation function that may be integrated into a chip-scale analytical separation device. The flow channels are connected to two different reservoirs for fluid flow and sample injection. Thus, micropumping, injection, or delivery functions are integrated onto the chip device.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. Having thus described the invention, what is desired to be protected by Letters Patent is presented in the subsequently appended claims.

What is claimed is:

1. A micropumping device, comprising:

a capillary for holding two immiscible, electrolyte fluids respectively disposed across an interfacial boundary within said capillary;

a first electrolyte fluid disposed in said capillary, and forming an interfacial boundary with a second electrolyte fluid, said first electrolyte fluid comprising an aqueous, ionic salt;

a second electrolyte fluid disposed in said capillary, and forming said interfacial boundary with said first electrolyte fluid, said second electrolyte fluid comprising an organic, dipolar fluid substance that is immiscible with said first electrolyte fluid;

a source of alternating voltage; and a pair of first and second electrodes each respectively connected to said source of alternating voltage, said first electrode being disposed within said first electrolyte fluid, and said second electrode being disposed within said second electrolyte fluid, wherein electrochemically controllable surface tension is created across said interfacial boundary, which surface tension provides a driving force for operating said micropumping device.

2. The micropumping device in accordance with claim 1, wherein said aqueous ionic salt is selected from a group of salts consisting of: alkaline halides, alkaline nitrates, alkaline nitrites, alkaline sulfates, alkaline sulfites, and combinations thereof.

3. The micropumping device in accordance with claim 2, wherein said ionic salt is in an approximate concentration range of 0.001 M to 0.1 M.

4. The micropumping device in accordance with claim 1, wherein said second electrolyte fluid comprises a dipolar organic fluid selected from a group of fluids consisting of; dichloroethane with tetraphenylammonium tetraphenylborate, nitrobenzene with hexadecylammonium tetraphenylborate, and combinations thereof.

5. The micropumping device in accordance with claim 4, wherein said dipolar organic fluid is in an approximate concentration in the range of 0.001 M to 0.05 M.

6. The micropumping device in accordance with claim 1, wherein said alternating current source comprises a square wave voltage source.

7. The micropumping device in accordance with claim 1, wherein said pair of first and second electrodes comprises platinum wires.

8. A micropumping device, comprising:

a capillary for holding two immiscible, electrolyte fluids respectively disposed across an interfacial boundary within said capillary;

a first electrolyte fluid disposed in said capillary, and forming an interfacial boundary with a second electrolyte fluid, said first electrolyte fluid comprising an aqueous, ionic salt disposed in said capillary;

a second electrolyte fluid which is disposed in said capillary, and comprising an organic, dipolar fluid substance that is immiscible with said first electrolyte fluid, and which forms an interfacial boundary therewith in said capillary;

a source of square wave voltage; and a pair of first and second electrodes each respectively connected to said source of square wave voltage, said first electrode being disposed within said first electrolyte fluid and said second electrode being disposed within said second electrolyte fluid, wherein electrochemically controllable surface tension is created across said interfacial boundary, which surface tension provides a driving force for operating said micropumping device.

9. The micropumping device in accordance with claim 8, wherein the square wave voltage of said source of square wave voltage comprises means for generating several volts at a frequency of approximately 1 Hz.

10. The micropumping device in accordance with claim 9, wherein said ionic salt is in an approximate concentration range of 0.001 M to 0.1 M.

11. The micropumping device in accordance with claim 8, wherein said first electrolyte fluid comprises an aqueous ionic salt selected from a group of salts consisting of: alkaline halides, alkaline nitrates, alkaline nitrites, alkaline sulfates, alkaline sulfites.

12. The micropumping device in accordance with claim 11, wherein said dipolar organic fluid is in an approximate concentration in the range of 0.001 M to 0.05 M.

13. The micropumping device in accordance with claim 8, wherein said second electrolyte comprises a dipolar organic fluid selected from a group of fluids consisting of: dichloroethane with tetraphenylammonium tetraphenylborate, nitrobenzene with hexadecylammonium tetraphenylborate, and combinations thereof.

14. The micropumping device in accordance with claim 8, wherein said pair of first and second electrodes comprises platinum wires.

* * * * *